US007207550B2

(12) United States Patent
Spiess et al.

(10) Patent No.: US 7,207,550 B2
(45) Date of Patent: Apr. 24, 2007

(54) ELEVATOR, PROCEDURE FOR THE MAINTENANCE OF THE ELEVATOR, PROCEDURE FOR THE MODERNIZATION OF AN ELEVATOR AND CLAMPING DEVICE FOR AN ELEVATOR

(75) Inventors: Peter Spiess, Meggen (CH); Gert Silberhorn, Kussnacht am Rigi (CH); Andreas Gaussmann, Hergiswil (CH); Peter Hitz, Dietwil (CH); Dieter Mehr, Ebikon (CH); Johannes Kocher, Udligenswil (CH)

(73) Assignee: Inventio AG, Hergiswil (CH)

( * ) Notice: Subject to any disclaimer, the term of this patent is extended or adjusted under 35 U.S.C. 154(b) by 396 days.

(21) Appl. No.: 10/659,102

(22) Filed: Sep. 10, 2003

(65) Prior Publication Data

US 2004/0045772 A1 Mar. 11, 2004

(30) Foreign Application Priority Data

Sep. 11, 2002 (EP) ..... 02405790

(51) Int. Cl.
*B66D 1/00* (2006.01)

(52) U.S. Cl. ..... 254/333; 187/254

(58) Field of Classification Search ..... 254/333, 254/334, 335, 336; 187/254, 251, 266
See application file for complete search history.

(56) References Cited

U.S. PATENT DOCUMENTS 4,260,615 A * 4/1981 Raether et al. ..... 514/297
5,207,308 A 5/1993 Sheffield et al.
6,364,062 B1 * 4/2002 Ericson et al. ..... 187/264
6,386,324 B1 * 5/2002 Baranda et al. ..... 187/254
6,742,627 B2 * 6/2004 Drabot et al. ..... 187/254

FOREIGN PATENT DOCUMENTS

| | | |
|---|---|---|
| EP | 0 837 025 | 4/1998 |
| SU | 506 566 | 3/1976 |
| WO | 02 064482 | 8/2002 |

* cited by examiner

*Primary Examiner*—Emmanuel M Marcelo
(74) *Attorney, Agent, or Firm*—Klaus P. Stoffel; Wolff & Samson PC

(57) ABSTRACT

An elevator having a car and a suspension member or respectively hoisting member for carrying an operating weight. Furthermore, a power transmission is intended for moving the suspension member and the hoisting member over at least one moving surface of the power transmission. The power transmission and the suspension member or respectively hoisting member are rope-shaped and/or belt-shaped. Also, the power transmission and the suspension member or respectively hoisting member are physically separated from each other. The power transmission and the suspension member or respectively hoisting member are stretched against at least one supporting body.

29 Claims, 3 Drawing Sheets

ELEVATOR, PROCEDURE FOR THE MAINTENANCE OF THE ELEVATOR, PROCEDURE FOR THE MODERNIZATION OF AN ELEVATOR AND CLAMPING DEVICE FOR AN ELEVATOR

BACKGROUND OF THE INVENTION

The present invention concerns an elevator, a procedure for the maintenance of the elevator, a procedure for the modernization of an elevator and a clamping device for an elevator.

A driving disk is often used with an elevator in order to move an elevator car. The driving disk and the car are joined together for example via a rope, with such a friction driven hoist. A drive puts the driving disk in a rotation movement. The rotation movement of the driving disk is converted into a motion of the car by a frictional engagement between the driving disk and the rope. The rope serves thereby as combined suspension means or respectively hoisting means, while the driving disk serves as power transmission means:

In its function as suspension means, the rope carries an operating weight of the elevator consisting of the empty weight of the car, the loading capacity of the elevator, an optional counterweight and the weight of the rope. The rope is charged thereby mainly by traction forces. For example, the car and the counterweight hang on the suspension means along the gravitational force.

In its function as hoisting means for moving the car, the rope is pressed onto a moving surface of the driving disk. The rope is thereby subject to pressing-stress and bending-stress. For example, the rope is pressed by the operating weight of the elevator on a range of the driving disk so that rope and the driving disk find themselves in frictional engagement.

In its function as power transmission means, the driving disk transfers the force of the drive to the rope. Important parameters thereby are a material-specific coefficient of friction between the driving disk and the rope and a construction-specific angle or arc of contact of the driving disk through the rope.

U.S. Pat. No. 4,620,615 reveals a friction driven hoist and in the case of this friction driven hoist, for the increase of the friction value between driving disk and rope, the rope is pressed against the driving disk over a special clamping device. The clamping device exhibits a multiplicity of pulleys, which are held in a frame and such pulleys are made of polyurethane and press the rope with a high coefficient of friction and in an angle or arc of contact against the driving disk.

SUMMARY OF THE INVENTION

A task of the present invention is of making available an elevator, which is simple and economical in the installation and maintenance. Also, an already existing elevator with components of this elevator should be able to be modernized simply and rapidly.

The invention resolves these tasks by a complete departure from the principle of the driving disk for moving the car of an elevator. Instead of using components such as a driving disk and a rope, the invention provides a separation in functions such as power transmission means, supporting body, suspension means or respectively hoisting means and clamping means. For this, several abstraction steps are carried out:

In a first step, the function of a power transmission means is split off concretely from the driving disk. This takes place by making available a special power transmission means. Preferably, the power transmission means is a rope-shaped and/or belt-shaped body.

In a second step, the function of the driving disk is reduced to a function as a supporting body. The supporting body is a support for the power transmission means and for the suspension means or respectively hoisting means. The supporting body can have any form. Preferably, the supporting body is at least part of a circumference of a rotational body like a disk or a pulley or a cylinder or a wheel.

In a third step, the power transmission means, the suspension means or hoisting means and the supporting body are brought together in operational connection. The power transmission means and the suspension means or hoisting means are stretched against the supporting body. Preferably, the power transmission means rests with at least one moving surface against the suspension means or hoisting means. Preferably, the power transmission means and/or the suspension means or hoisting means rests/rest against the supporting body. By such there is understood to be a direct physical contact of the components. The operational connection of the power transmission means, the suspension means or hoisting means and the supporting body takes place via frictional engagement and/or positive locking and/or frictional connection. Preferably, the stretching of the power transmission means as well as of the suspension means or hoisting means against the supporting body takes place via the power transmission means and/or via the suspension means or hoisting means and/or via a clamping means separated physically from the power transmission means as well as from the suspension means or hoisting means. In principle, a stretching of the suspension means or hoisting means against the supporting body takes place via the operating weight of the elevator. Preferably, the clamping means is a rope-shaped and/or belt-shaped body and/or a rotational body like a disk or a pulley or a cylinder or a wheel.

In a fourth step, a driving disk is no longer shifted in motion directly by a drive, but instead the power transmission means. Preferably, the ends of the power transmission means loop-shaped closed are connected together.

The Following Advantages are Realized by the Invention:

The elevator has a low cost relative to installation and maintenance.

The elevator and its components can be arranged as freely as possible in the case of planning and installation.

An existing elevator can, with these components, be modernized simply and rapidly.

The elevator and its components are designed in modular system.

The elevator exhibits a small as possible dimensioned drive.

The coefficient of friction between the power transmission means and the suspension means or hoisting means is high and the angle or arc of contact is as small as possible.

The components of the elevator, such as drive and car with functions such as brakes, are system-integrated.

The components of the elevator such as car, rope, and counterweight are built as easily as possible.

In the following, the advantages of the invention as well as exemplary embodiment forms of the invention are described in detail based on the drawings.

DETAILED DESCRIPTION OF THE PREFERRED EMBODIMENTS

Figure 1:
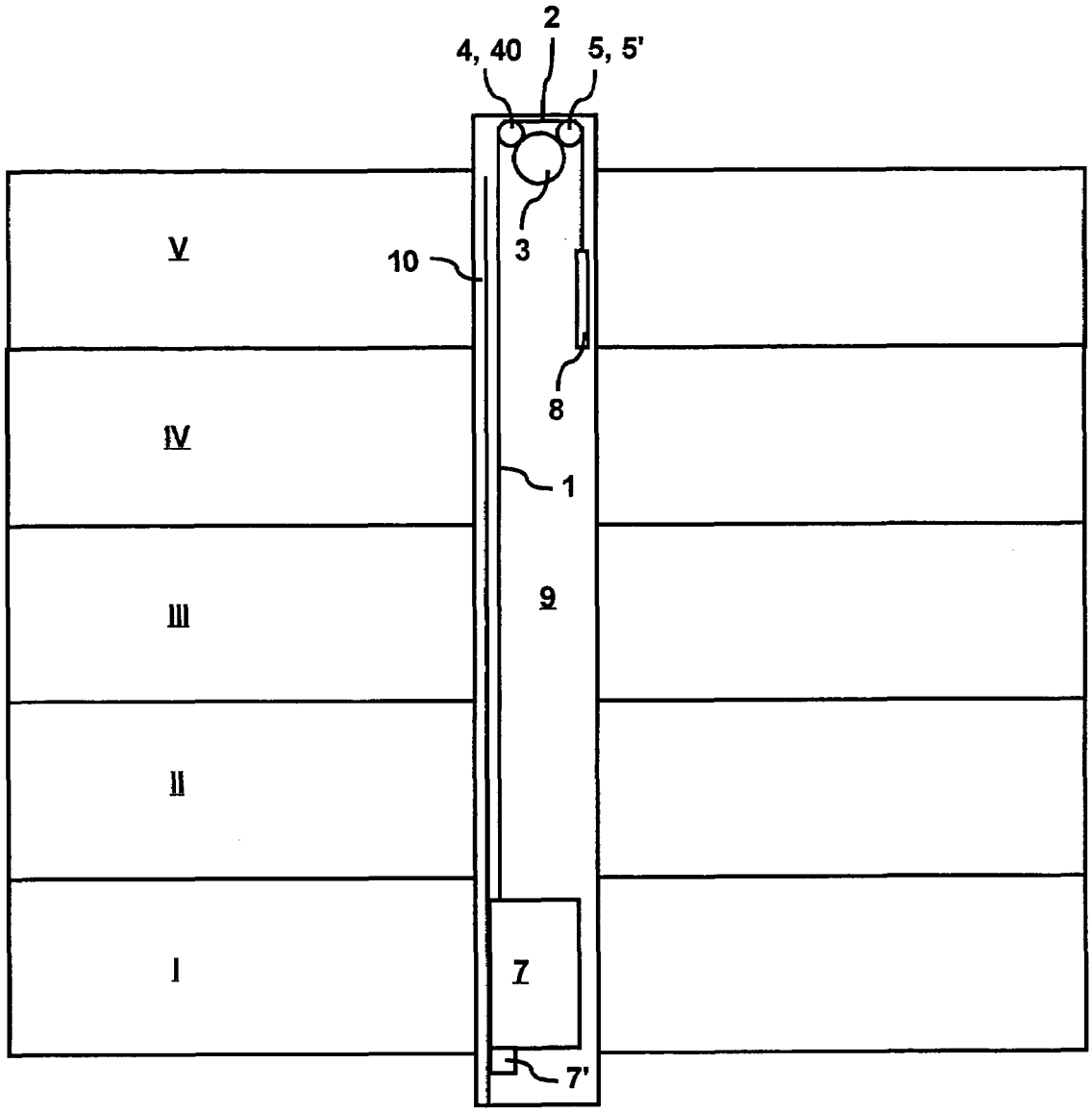
FIG. 1 is a schematic representation of the most important components of the elevator.

In accordance with FIG. 1, the elevator exhibits, in a building with floors I, II, III, IV, V and a hoistway 9, preferably, the components suspension means or hoisting means 1, the power transmission means 2, the guiding devices 10, the drive 5, the car 7, the counterweight 8, the supporting body 3, the brakes 5', 40, 7', and the clamping device 4, 4', 4". The disposition as well as the proportion in size of the components of the elevator, in accordance with FIG. 1, is exemplary and not binding for the interpretation of the invention. Thus, it is definitely possible to arrange the drive not in the hoistway, but instead in a separate engine room. It is also possible to employ an elevator without a hoistway floor or respectively without a hoistway roof, so that the hoistway does not rise above the ground plate of the lowest floor or respectively the roof of the highest floor.

As shown in the detail in the FIGS. 2 to 5, the power transmission means 2 with a moving surface 20 rests against the suspension means or hoisting means 1. The power transmission means 2 rests with a moving surface 20' against the supporting body 3 and/or against the clamping means. Preferably, a difference is made between a rotational body type of clamping means 4', 4" and rope-shaped and/or belt-shaped clamping means 4". Preferably, a difference is made between a regulating brake 5' of the drive, a retaining brake 40 of a clamping device and a decelerating brake 7' of the car. Optionally the drive exhibits at least an auxiliary pulley 6. Preferably, the drive, the supporting body, the rotational body type of clamping means and the auxiliary pulley are rotatable in two opposite directions of rotation (see curved double arrows).

Figure 2A:
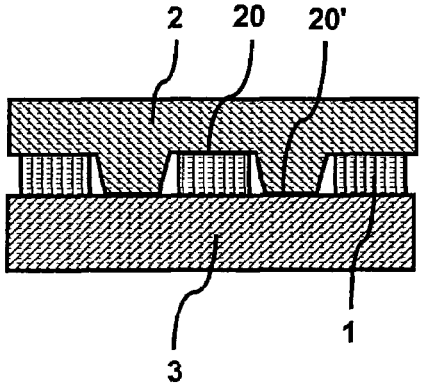
FIGS. 2*a* and 2*b* are schematic representations of a first embodiment form of an elevator with belt-shaped power transmission means and belt-shaped suspension means or hoisting means, which are stretched against the supporting body.
Figure 2B:
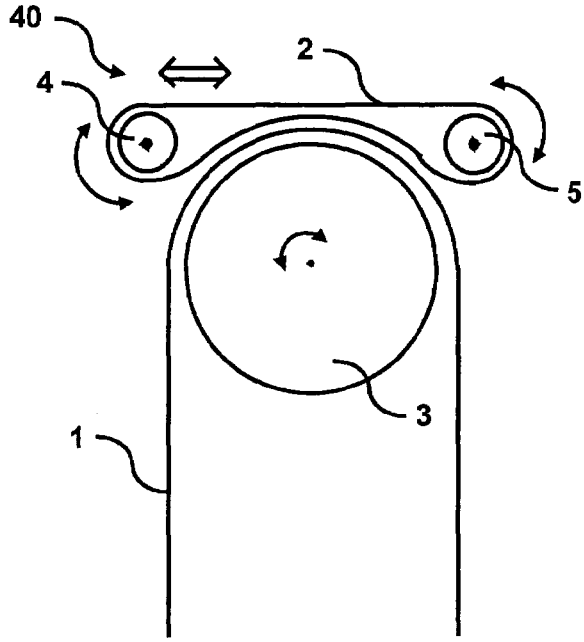

The embodiment forms in accordance with FIGS. 2 to 5 differ themselves moreover as follows:

In accordance with FIGS. 2*a* and 2*b*, the elevator exhibits a belt-shaped suspension means or hoisting means 1, a belt-shaped power transmission means 2 and a rotational body type of clamping means 4. The power transmission means 2 is stretched/released through the relative motion of the clamping means 4 concerning the drive 5 (see straight double arrow).

Figure 3A:
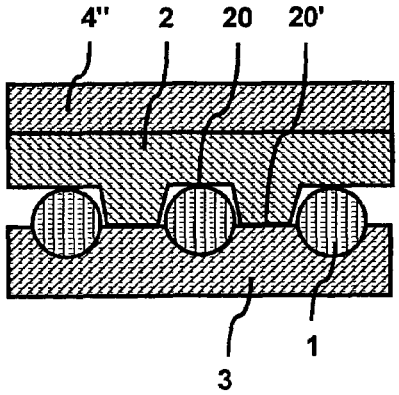
FIGS. 3*a* and 3*b* are schematic representations of a second embodiment form of an elevator with belt-shaped power transmission means and rope-shaped suspension means or hoisting means, which are stretched against the supporting body.
Figure 3B:
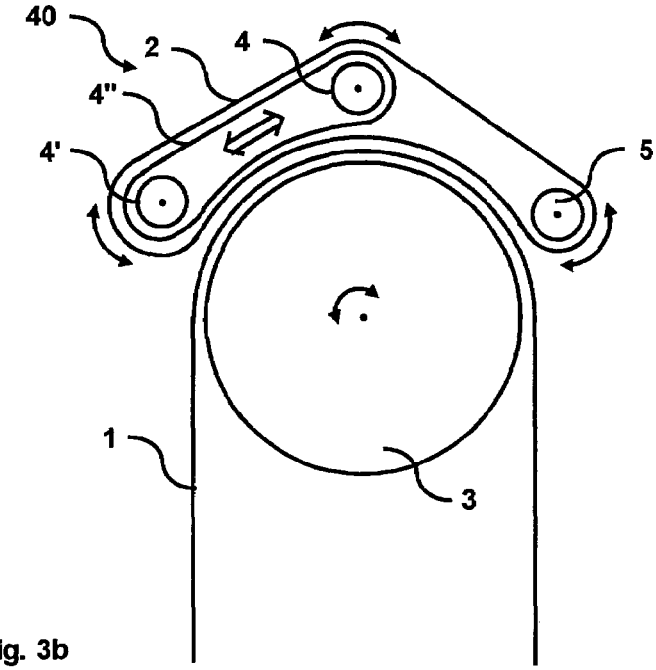

In accordance with FIGS. 3*a* and 3*b*, the elevator exhibits a rope-shaped suspension means or hoisting means 1, a belt-shaped power transmission means 2, a belt-shaped clamping means 4" and two rotational body type of clamping means 4, 4'. The belt-shaped clamping means 4" is preferably stretched/released through the relative motion of the two rotational body type of clamping means 4, 4' against each other (see straight double arrow).

Figure 4A:
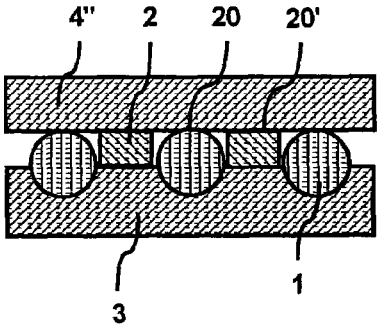
FIGS. 4*a* and 4*b* are schematic representations of a third embodiment form of an elevator with belt-shaped power transmission means and rope-shaped suspension means or hoisting means, which are stretched against the supporting body.
Figure 4B:
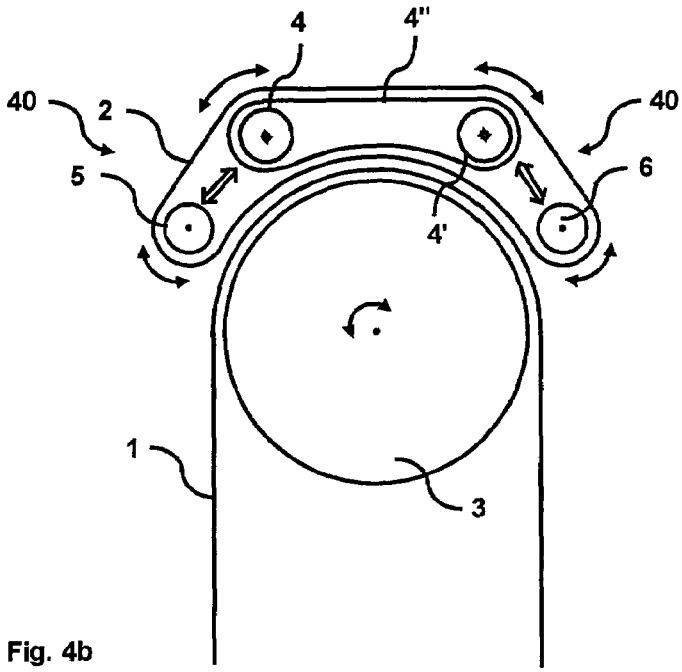

In accordance with FIGS. 4*a* and 4*b*, the elevator exhibits a rope-shaped suspension means or hoisting means 1, a belt-shaped power transmission means, a belt-shaped clamping means 4" and two rotational body type of clamping means 4, 4'. The belt-shaped clamping means 4" is preferably stretched/released through the relative motion of everyone of the two rotational body type of clamping means 4, 4' concerning the drive 5 and the auxiliary pulley 6 (see straight double arrows).

Figure 5A:
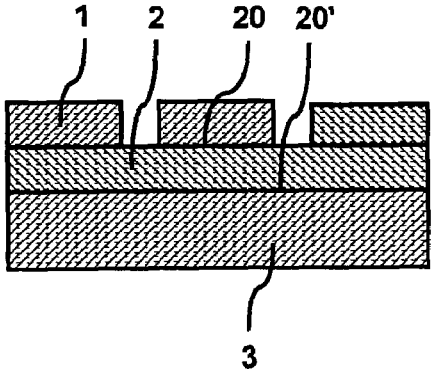
FIGS. 5*a* and 5*b* are schematic representations of a fourth embodiment form of an elevator with belt-shaped power transmission means and belt-shaped suspension means or hoisting means, which are stretched against the supporting body.
Figure 5B:
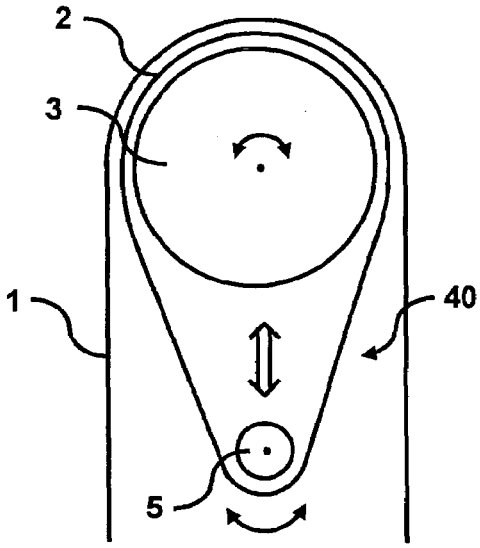

In accordance with FIGS. 5*a* and 5*b*, the elevator exhibits a belt-shaped suspension means or hoisting means 1 and a belt-shaped power transmission means 2. The belt-shaped power transmission means 2 is preferably stretched/released through the relative motion of the drive 5 concerning the supporting body 3 (see straight double arrow).

By the aforementioned abstraction steps, one obtains a strict function separation into power transmission means, suspension means or hoisting means, clamping means and supporting body. These components of the elevator can be optimized separately in accordance with various criteria and with parameters. This function-separated elevator exhibits the following advantages.

Suspension means or hoisting means: For the purposes of the present invention, each well-known and proved suspension means or hoisting means for elevators can be set in. Preferably, a combined suspension means or hoisting means for carrying the operating weight as well as for moving the car and an optional counterweight is provided. In principle, the functions of the suspension means and the hoisting means can also be separated from each other. Thus, it is possible, with knowledge of the invention, to provide a suspension means for carrying the operating weight and independently from it to provide a hoisting means for moving the car whereby only the hoisting means is moved by the power transmission means. For example, the car and the counterweight hang on a rope as suspension means and are moved from a balance rope as hoisting means. Preferably, the suspension means and the hoisting means is a rope, a main and tail rope and/or a belt like a flat belt, toothed belt, V-belt, etc. The toothed belt can exhibit teeth on one or both of its sides. Multiple materials such as metal and/or natural substance and/or synthetic material can be used. As metal is designated steel, steel alloys, etc., as natural substance is designated leather, impregnated leather, rubber, etc., as synthetic material is designated aramide, nylon, polyurethane, carbon fibre, zylon, etc. The suspension means or respectively hoisting means can have a casing made of the most rubbing resistant material such as polyurethane, nylon, etc. Finally, the suspension means or respectively hoisting means can exhibit layers for the take up of traction forces and such layers are made of steel, steel alloys, aramide, carbon fibre, zylon, etc. Preferably, the suspension means or respectively hoisting means exhibits closed ends, which form a loop. Preferably, the suspension means or respectively hoisting means exhibits open ends and is connected with the car and the counterweight.

Coefficient of friction: Preferably, the components power transmission means, suspension means or hoisting means, clamping means and supporting body, being in direct contact with one another, exhibit optimized coefficients of friction. By a suitable choice of the materials used are realized, preferably, between these components coefficients of friction>=0.2, preferably>=0.3, preferably>=0.4, preferably>=0.6, preferably>=0.9. For example, the areas of contact of these components are composed of metal such as steel, steel alloys, aluminium, aluminium alloys, etc. and/or of natural substance such as leathers, leather impregnations, rubber, etc. and/or of synthetic material such as polyurethane, nylon, carbon fiber, etc.

Drive: These high coefficients of friction have a high traction as an effect, whereby only a relatively small-dimensioned drive is needed. Preferably, the drive is a gearless linear drive. Preferably, the drive is of oblong cylindrical form or a flat external rotor. With knowledge of the present invention, various possibilities of the variation of drives present themselves to the man skilled in the art. Preferably, the cylindrical drive exhibits volume mass (length×width×depth) of>=100×20×20 $cm^3$, preferably>=85×18×18 $cm^3$, preferably>=70×15×15 $cm^3$. Preferably, the flat external rotor drive exhibits volume mass (length×width×depth) of>=100×100×20 $cm^3$, preferably>=85×85×18 $cm^3$, preferably>=70×70×15 $cm^3$.

Angle or arc of contact: These high coefficients of friction have a high traction as an effect, whereby only a relatively small angle or arc of contact is needed. Preferably, the angle or arc of contact from the power transmission means and/or the suspension means or respectively hoisting means and/or clamping means with the supporting body is<=180°, preferably<=150°, preferably<=120°, preferably<=90°.

Gear or speed ratio: Preferably, the drive and the suspension means or hoisting means are geared to each other, i.e. a motor shaft turns itself faster around its axis of rotation as the suspension means or hoisting means moves with the supporting body. This gear or speed ratio follows from the proportion in size of the diameter of the supporting body to the diameter of the motor shaft. Preferably, this proportion in size is>1, preferably>=5, preferably>=10, preferably>=15, preferably>=20.

Clamping means: The clamping means is, preferably, rope-shaped and/or belt-shaped and/or of a rotational body type. Preferably, the rope-shaped and/or belt-shaped clamping means corresponds in the kind and structure to the rope-shaped and/or belt-shaped power transmission means, or respectively suspension means, or respectively hoisting means, so that the previous discussion thereof is referred to. Preferably, the rope-shaped and/or belt-shaped clamping means exhibits closed ends, which form a loop. Preferably, the rotational body type of clamping means is a disk or a pulley or a cylinder or a wheel, etc. and rotates around an axis of rotation. The power transmission means via the rope-shaped and/or belt-shaped clamping means rests on a surface of this rotational body. With knowledge of the present invention, the man skilled in the art can use, of course, also different well-known clamping means. Thus, other clamping means can be used, i.e. stationary wall, a plate, etc., by which the power transmission means via the rope-shaped and/or belt-shaped clamping means slides over a surface.

Clamping device: A clamping device serves for stretching/releasing the power transmission means and the suspension means or respectively hoisting means and/or the rope-shaped and/or a belt-shaped clamping means against the supporting body. Preferably, the clamping device comprises at least two components of the elevator, which through relative motion to each other stretch or respectively release the power transmission means and/or the suspension means or respectively the hoisting means and/or the rope-shaped and/or belt-shaped clamping means against the supporting body. Preferably, via the clamping device, a first rotational body type of clamping means is moved relatively to another rotational body type of clamping means and/or a rotational body type of clamping device is moved relatively to the drive and/or a rotational body type of clamping means is moved relatively to the auxiliary pulley and/or the drive is moved relatively to the supporting body. With knowledge of the present invention, the man skilled in the art can, of course, also employ clamping devices with other well-known clamping mechanisms. Thus, for the aforementioned stretching/releasing, also the diameter of the rotational body type of clamping means lets itself be increased/reduced, without that thus a relative motion of the same is necessary. For example, such a diameter variation of the rotational body type of clamping means takes place via the scattering/folding of an upper surface of the rotational body type of clamping means. The man skilled in the art has in this connection numerous possibilities available. The considerations for rotational body type of clamping means apply of course also to clamping means like a fixed, i.e. stationary wall, plate, etc.

Supporting body: The supporting body can have any form. Preferably, the supporting body is part of a circumference of a rotational body like a disk or a pulley or a cylinder or a wheel or part of a circumference of a wall or a plate. Preferably, this rotational body is placed freely swivelling around an axis of rotation. Preferably, the diameter of this rotational body is of circular symmetry. Preferably, the wall or the plate is fixed, i.e. stationary. The primary function of the supporting body consists, in this respect, of supplying a stable support for an optimal transmission of the traction force to the power transmission means and the suspension means or respectively hoisting means. The supporting body is thus stably enough realized in order to develop a counterforce to these traction forces.

Procedure for the operation of the elevator: Preferably, components of the elevator such as the drive and the car are system integrated with functions such as brakes. With the notion of system integration is understood an optimization, undertaken out from a system view, of individual components, i.e. this optimization of the components is seen in the whole system of the elevator, co-ordinated one with the other. Preferably, an allocation of brake functions such as regulating brake, retaining brake, decelerating brake and safety gear brake takes place on individual but optimized components of the elevator.

Preferably, the drive is made from lightweight construction materials such as steel, steel alloys, aluminum, aluminum alloys, carbon fiber, zylon, etc. Due to such a lightweight construction, when operating the drive, only small masses are accelerated and respectively braked. Preferably, the drive therefore only has a regulating brake 5'. By braking with regulating brakes, the speed of the car is held approximately constant or respectively the speed of the car follows a target curve. In particular, when lowering moving masses, the regulating brake absorbs potential energy and prevents thereby their transformation into kinetic energy.

Preferably, the supporting body is made of lightweight construction materials such as steel, steel alloys, aluminum, aluminum alloys, carbon fibre, zylon, etc. Preferably, the supporting body is a spoked wheel with a hub, spokes and a rim. With such a lightweight construction, when moving the supporting body, only small masses are accelerated or respectively braked. Such a supporting body is energy saving to accelerate and lets itself be braked with relatively weakly dimensioned brakes. Preferably, for the supporting body no independent brake is provided.

In a favorable way, the drive and/or the supporting body and/or the power transmission means and/or the suspension means or hoisting means and/or the clamping device are from lightweight construction materials, whereby these components exhibit relatively small masses, which makes possible to employ the retaining brake 40 as the clamping device. The clamping device fulfils a stop function, if it protects stationary masses against unintentional movement due to their weight or other forces acting in the moving direction. Preferably this is reached, in the case when the tension force is variably adjusted in magnitude. Preferably, by stopping at the floors, the tension force is increased, with the power transmission means and suspension means or respectively hoisting means acting on the supporting body. Preferably, this increased tension force is again decreased at the time of leaving the floor.

Preferably, at least one brake of the car is employed as the decelerating brake 7' and/or the safety gear brake. The decelerating brake of the car is preferably a rail or track brake, which absorbs kinetic energy and thus decelerates the rate of motion of the moving masses. With knowledge of the present invention, the man skilled in the art can, of course, employ different brakes as the decelerating brake, for example he can employ a drum brake, etc.

Procedure for the disposition of the elevator: preferably, the drive, the power transmission means, the suspension means or respectively hoisting means, the clamping means and the supporting body are arranged in a hoitsway of the elevator, preferentially in the hoistway roof of the elevator. Due to the often restrained space conditions in the hoitway and with the aim of using the space in the hoistway as optimally as possible, the disposition of the components can be freely planned within the scope of the disposition parameters.

These Disposition Parameters Dictate:

The type of the power transmission means/suspension means or respectively hoisting means: the power transmission means/suspension means or respectively hoisting means is rope-shaped and/or belt-shaped. Also, different materials are employed. The different shaping and different employed materials affect the fatigue limit of the power transmission means/suspension means or respectively hoisting means. The type of the power transmission means/suspension means or respectively hoisting means becomes apparent, for example, in the admissible bending radius at the supporting body. Often, also for this, the admissible ratio of diameters from the diameter of the supporting body to the diameter of the power transmission means/suspension means or respectively hoisting means is also raised as a parameter. Thus, steel cables on traditional driving disks have an admissible ratio of diameters from 40 to 45, while aramide ropes exhibit an admissible ratio of diameters from 16 to 18 and nylon belts exhibit an admissible ratio of diameters from 10 to 11. The supporting body for aramide ropes requires therefore approximately 2.5 times less place as the one for steel cables, the supporting body for nylon belts needs approximately 10 times less place than the one for steel cables. The man skilled in the art has thus, with the teachings of the present invention, numerous possibilities of matching the space conditions available with the type of employed power transmission means/suspension means or respectively hoisting means. With this disposition, material-specific and form-specific ratios of diameter are employed. Preferably, the embodiments in accordance with FIGS. 2 and 5 are suitable, where power transmission means as well as suspension means or respectively hoisting means are belt-shaped, for particularly narrow space conditions. The embodiments in accordance with FIGS. 3 and 4, where the power transmission means is belt-shaped and the suspension means or respectively hoisting means is rope-shaped, are suitable for less narrow space conditions. Preferably, the power transmission means and the rope-shaped and/or belt-shaped clamping means exhibit closed ends and form a loop. The length of such a loop is freely adjustable. Also, the course of such a loop in the hoistway may be freely planned. For example, such a loop can be deviated over the auxiliary pulleys around any obstacle such as safety rail, breaks of a wall, etc.

Form, size and disposition of the drive: The small dimensioned drive can be arranged in the hoistway in a space-saving manner. It can thereby be disposed in multiple ways and it is economical to install and maintain. For example, a flat external rotor is particularly favorable for a disposition in the hoistway area above the flat counterweight, so that, in such a position, it can be overrun by the car. An oblong cylindrical drive is again suitable particularly for a disposition at the safety rails, so that the drive—just as the car and/or the counterweight—is only fastened to these safety rails and forces are guided when operating the elevator only over these safety rails into the hoistway floor. With knowledge of the present invention, numerous possibilities of disposition of small-dimensioned drives in the hoistway are at the disposal of the man skilled in the art.

Size of the angle or arc of contact: Through the small angle or arc of contact, the possible disposition of the components in the hoistway is further increased. Thus, the drive, the power transmission means, the suspension means or respectively hoisting means, the clamping means and the supporting body let themselves be arranged also under a small angle or arc of contact. Also, an auxiliary pulley for the enlargement of the angle or arc of contact is in principle not necessary and thus only optional.

Diameter of the supporting body: Preferably, the diameter of the supporting body can be freely dimensioned. This makes possible in a simple and visible way a modular adaptation of the performance and the speed of the elevator. Preferably, the drive is offered in one or more variant(s) (for example: economical, normal, strong) and lets itself be combined preferably with several variants of diameters of the supporting body (for example: fast, average, slow). With three times three variants, a system of components for an elevator is available to the customer, by which the drive presents a first system of components and the supporting body presents a second system of components. Preferably, several variants are at the disposal for each system of components, and these variants are combinable into a system. Preferably, the variants of the drive and the variants of the supporting body result in nine modular system variants matched one by one.

Size and type of the clamping device: Preferably, the clamping device comprises at least two components of the elevator which, through the relative motion to each other, the power transmission means and/or the suspension means or relatively hoisting means and/or rope-shaped and/or belt-shaped clamping means, stretch(es) or respectively release(s) against the supporting body. In the embodiments in accordance with FIGS. 2 to 5, the clamping device comprises the rope-shaped and/or belt-shaped and/or rotational body type of clamping means. The embodiments of the clamping device in accordance with FIGS. 2 and 5 need less space above the highest point of the suspension means or respectively hoisting means than those in accordance with FIGS. 3 and 4.

Procedure for the maintenance of the elevator: preferably, the power transmission means is an economical and easily to be replaced wear part, for example, a belt made of synthetic material, while the suspension means or respectively hoisting means and the supporting body are long-lived capital goods, which do not have to be replaced or are replaced very rarely. The power transmission means consequently lets itself be replaced in a procedure for the maintenance of the elevator both simply and rapidly. For this, a power transmission means to be replaced is released from its stretched operating position against the supporting body. The power transmission means to be replaced is removed. In lieu of the power transmission means to be replaced, a replaceable power transmission means is positioned. The replaceable power transmission means is stretched against the supporting body. As represented on embodiments in FIGS. 2 to 5, a power transmission means to be replaced is stretched/released either through the relative motion of a clamping means relatively to the drive (FIG. 2), or through the relative motion to each other of the rotational body type of clamping means (FIG. 3), or through the relative motion of rotational body type of clamping means relatively to the drive and the auxiliary pulleys (FIG. 4), or through the relative motion of the drive relatively to the supporting body (FIG. 5) (see straight double arrow(s)). Preferably, the suspension means or respectively hoisting means is not removed from the supporting body with the change of the power transmission means (FIGS. 2 to 4).

In the case of usage of rope-shaped and/or belt-shaped clamping means, the change of the power transmission means proceeds in a similar fashion. As represented in the embodiments in accordance with FIGS. 3 and 4, a rope-shaped and/or belt-shaped clamping means to be replaced is stretched/released either through the relative motion to each other of the rotational body type of clamping means (FIG. 3) or through the relative motion of the rotational body type of clamping means relatively to the drive and the auxiliary pulleys (FIG. 4). The power transmission means and/or the rope-shaped and/or belt-shaped clamping means let themselves be replaced together or separately.

Procedure for the modernization of an elevator: Preferably, the power transmission means and the clamping device are later incorporable into the elevators, in particular in the case of modernizations. Due to the previously described high freedom with the disposition of the components in the hoistway, existing elevators let themselves be modernized rapidly and simply with power transmission means and a clamping device. For this, the driving disk of an existing elevator is separated from its drive. Preferably, the driving disk and/or the drive is removed. Preferably, a supporting body is installed instead of the driving disk or the driving disk is employed as a supporting body. Preferably, a small-dimensioned drive is installed instead of the existing drive or the existing drive is further employed. Thereupon, the power transmission means, moving the suspension means or respectively hoisting means, is installed. Preferably, the power transmission means is installed over a clamping device on the suspension means or respectively hoisting means. The power transmission means as well as the suspension means or respectively hoisting means are stretched against the supporting body.

The invention is not limited by the embodiments described above which are presented as examples only but can be modified in various ways within the scope of protection defined by the appended patent claims.

The invention claimed is:

1. An elevator, comprising: a car; a supporting body; suspension or hoisting means for carrying an operating weight, which suspension or hoisting means rests against the supporting body, the suspension means being one of rope-shaped and belt-shaped; a rope-shaped or belt-shaped power transmission means for moving the suspension or hoisting means via at least one moving surface; and a drive arranged to drive the power transmission means, the power transmission means being in tension against the suspension or hoisting means and being in contact with the supporting body.

2. An elevator in accordance with claim 1, wherein the power transmission means is in direct contact with the supporting body via at least one moving surface of the power transmission means.

3. An elevator in accordance with claims 1, wherein the power transmission means is formed as a loop.

4. An elevator in accordance with claim 1, and further comprising clamping means for clamping the power transmission means against the suspension or hoisting means, the clamping means being one of rope-shaped and belt-shaped.

5. An elevator in accordance with claim 4, wherein the clamping means has layers for a take up of traction forces, the layers being made of at least one of the group consisting of steel, nylon, aramide and zylon.

6. An elevator in accordance with claim 4, wherein the clamping means has a casing made of one of polyurethane and nylon.

7. An elevator in accordance with claim 1, wherein the power transmission means has layers for a take up of traction forces, the layers being made of at least one of the group consisting of steel, nylon, aramide and zylon.

8. An elevator in accordance with claim 1, wherein the power transmission means has a casing made of one of polyurethane and nylon.

9. An elevator in accordance with claim 1, wherein the suspension or hoisting means is an outside, interlaced, toothed belt.

10. An elevator in accordance with claim 1, and further comprising a regulating brake, the drive being operative only for accelerating the car and for braking the car via the regulating brake.

11. An elevator in accordance with claim 1, wherein the supporting body is configured not to have an independent brake.

12. An elevator in accordance with claim 1, and further comprising a clamping device arranged so as to stretch the power transmission means and the suspension or hoisting means against the supporting body, the clamping device being operatively arranged to act as a brake.

13. An elevator in accordance with claim 12, wherein the clamping device is configured to exert a tension force that is variably adjustable.

14. An elevator in accordance with claim 1, and further comprising a decelerating brake for the car.

15. An elevator in accordance with claim 1, wherein the drive is a gearless linear drive.

16. An elevator in accordance with claim 1, wherein the drive is configured to have an oblong, cylindrical shape.

17. An elevator in accordance with claim 1, wherein the drive is a flat external rotor motor.

18. An elevator in accordance with claim 1, wherein the power transmission means, the suspension or hoisting means and the supporting body are in direct mutual contact and have coefficients of friction>/=0.2.

19. An elevator in accordance with claim 18, wherein the coefficients of friction are>/=0.3.

20. An elevator in accordance with claim 19, wherein the coefficients of friction are>/=0.4.

21. An elevator in accordance with claim 20, wherein the coefficients of friction are >/=0.6.

22. An elevator in accordance with claim 21, wherein the coefficients of friction are >/=0.9.

23. A clamping device for an elevator with a rope-shaped or belt-shaped suspension or hoisting means for carrying an operating weight, which rests against a supporting body, with a rope-shaped or belt-shaped power transmission means for moving the suspension or hoisting means via at least one moving surface, and a drive to drive the power transmission means, the power transmission means being stretched against the suspension or hoisting means, the clamping device comprising an apparatus that at least one of stretches the power transmission means and the suspension or hoisting means against the supporting body, and stretches the power transmission means and the suspension or hoisting means and a clamping means that is at least one of rope-shaped and belt-shaped against the supporting body, and the power transmission means being in contact to the supporting body.

24. A clamping device in accordance with claim 23, wherein the apparatus is formed by at least two components of the elevator which are moveable relative to each other so that at least one of the power transmission means, the suspension or hoisting means, and the clamping means are tensionable against and releasable from the supporting body.

25. A process for maintaining an elevator having a car, a rope-shaped or belt-shaped, suspension or hoisting means for carrying an operating weight, which rests against a supporting body, a rope-shaped or belt-shaped power transmission means for moving the suspension or hoisting means via at least one moving surface, a drive for driving the power transmission means, a clamping device which at least one of stretches the power transmission means and the suspension or hoisting means against the supporting body, and stretches the power transmission means and the suspension means or hoisting means and a clamping means that is at least one of rope-shaped and belt-shaped against the supporting body, the process comprising the steps of: releasing a power transmission means to be replaced from the supporting body; removing the power transmission means to be replaced; positioning a replacement power transmission means in place of the removed power transmission means to be replaced; and stretching the replacement power transmission means against the supporting body.

26. A process in accordance with claim 25, wherein the stretching step includes stretching the power transmission means and the suspension or hoisting means with a clamping means having at least one of rope-shaped and belt-shaped form that is separated physically from the power transmission means and from the suspension or hoisting means, the process further including replacing the clamping means by releasing the clamping means to be replaced, removing the clamping means to be replaced, positioning a replacement clamping means in a place of the clamping means to be replaced, and stretching the replacement clamping means.

27. A process in accordance with claim 26, including separately replacing the power transmission means to be replaced and the clamping means to be replaced.

28. A process in accordance with claim 26, including replacing the power transmission means to be replaced and the clamping means to be replaced together.

29. A process for modernizing an elevator having a car, a rope-shaped or belt-shaped suspension or hoisting means for carrying and operating weight, a driving disk for moving the suspension or hoisting means, the driving disk having a drive, the process comprising the steps of: separating the driving disk and the drive of the driving disk from one another; installing a power transmission means that is at least one of rope-shaped and belt-shaped for moving the suspension or hoisting means; and stretching the power transmission means and the suspension or hoisting means against at least one supporting body.

* * * * *